United States Patent [19]

Kawakubo et al.

[11] Patent Number: 5,007,358

[45] Date of Patent: Apr. 16, 1991

[54] CLOTH PRESSER PROVIDED WITH A THREAD END HOLDER

[75] Inventors: Kiyoshi Kawakubo; Shuichi Sato, both of Tochigi, Japan

[73] Assignee: SSMC Inc., Edison, N.J.

[21] Appl. No.: 374,892

[22] Filed: Jul. 3, 1989

[30] Foreign Application Priority Data

Jul. 26, 1988 [JP] Japan ..... 63-97941[U]

[51] Int. Cl.[5] ..... D05B 29/06; D05B 27/04

[52] U.S. Cl. ..... 112/235; 112/302

[58] Field of Search ..... 112/235, 253, 295, 302

[56] References Cited

U.S. PATENT DOCUMENTS 3,224,397 12/1965 Van Ness ..... 112/235 X

*Primary Examiner*—Werner H. Schroeder
*Assistant Examiner*—Paul C. Lewis
*Attorney, Agent, or Firm*—Theodore Jay

[57] ABSTRACT

A thread end guide groove communicating with a needle location groove is defined in a cloth presser foot. A knife is secured to the rear surface of the cloth presser foot and extends across the thread end guide groove. A needle thread restriction plate is provided on the cloth presser foot and open at the side of a thread end holder. The needle thread restriction plate covers the upper surface of the thread end guide groove so that an inclined angle $\theta 1$ defined between an inclined portion of the needle thread restriction plate and a sewn material is set to be greater than an inclination angle $\theta 2$ defined between the extension thread and the sewn material.

2 Claims, 3 Drawing Sheets

CLOTH PRESSER PROVIDED WITH A THREAD END HOLDER

BACKGROUND OF THE INVENTION

1. Field of the Invention

The present invention relates to a cloth presser provided with a thread end holder and a knife for cutting the end of the thread used at the beginning of a stitching operation.

2. Description of the Prior Art

An extension portion of thread available at the beginning of the stitching material to be sewn is useless and hinders the stitching operation with the progress of the stitching operation so that it is preferable to sever this portion by cutting it off the thread at the beginning of the stitching operation. For example, Japanese Utility Model Laid-Open Publication No. 62-109079 discloses means to cut the extension portion of thread while holding the end of the needle thread. That is, as shown in an exploded view of the prior art in FIG. 5 hereof, a cloth presser foot 3 is used. As shown in further detail in FIGS. 6 and 7 hereof, in this prior art a needle thread end guide groove 4 is cut into the cloth presser foot 3 and communicates with a needle location groove 3*a* at the side of a thread end holder 15. The cloth presser foot 3 has at the rear surface thereof a recess 5 to which a knife 6 is secured and has a screw hole 5*a*. The recess 5 crosses the thread end guide groove 4. The knife 6 has a hole 6*a* therethrough and is secured in the knife recess 5 in such a manner that a blade thereof crosses the thread guide groove 4 while a set screw 7 is inserted through hole 6*a* and screwed into hole 5*a*. The needle location 3*a* has a chamfer 8 at a base side thereof disposed under the cloth presser foot 3 and direction to the thread end guide groove 4 for guiding the thread. The needle location groove 3*a* has another chamfer 9 at an upper edge thereof at the side of the thread end holder 15. A member 10 is embedded in the knife fixing groove 5 in confronted relation with the knife 6 while crossing the thread end guide groove 4.

The cloth presser foot 3 is pivoted by a supporter and used as a cloth presser.

When the stitching operation is started, a needle thread B is held by the thread end holder 15 and forms an extension portion C between the thread end holder 15 and a first stitch D made in the sewn material E as shown in FIG. 6. With the prgress of the stitching operation, the first stitch D is guided by the chamfers 8, 9 to enter into the thread end guide groove 4 and contact the fixed knife 6 and is cut thereby.

However, at the time of cutting the extension thread C by the fixed knife 6 the stitching condition is changed such as the stitching speed is changed, causing the needle thread B to slide into the thread end guide groove 4 and be severed by the fixed knife. To prevent this undesired action, the needle thread B must not slide into the thread end guide groove 4.

SUMMARY OF THE INVENTION

It is therefore an object of the present invention to prevent this undesired action by employing a cloth presser provided with a thread end holder capable of cutting only the extension portion of the thread at the first stage of the stitching operation without cutting the needle thread incidentally during the stitching operation whereby the working efficiency can be substantially improved.

To achieve this object, a cloth presser provided with a thread end holder according to the present invention comprises a thread end holder positioned beside the cloth presser and having a presser supporter. A cloth presser foot is pivotally mounted on the presser supporter and composed of a base, with a pair of projections projecting laterally from the base. A needle location groove is defined between the pair of projections. A thread end guide groove is defined in the base and communicates with the needle location groove. A needle thread restriction plate is mounted on the cloth presser foot for preventing a needle thread from sliding into the thread end groove. A stationary knife is secured to a lower surface of one of the lateral projections of the cloth foot and extends transversely thereto to across the thread end guide groove. The needle thread restriction plate covers the upper surface of the thread end guide groove in such manner that an inclined angle $\theta 1$ defined between an inclined portion of the needle thread restriction plate and a sewn material is set to be greater than an inclination angle $\theta 2$ defined between the extension thread and the sewn material.

The above and other objects, features and advantages of the present invention will become more apparent from the following description taken in conjunction with the accompanying drawings.

DESCRIPTION OF THE PREFERRED EMBODIMENT

Figure 1:
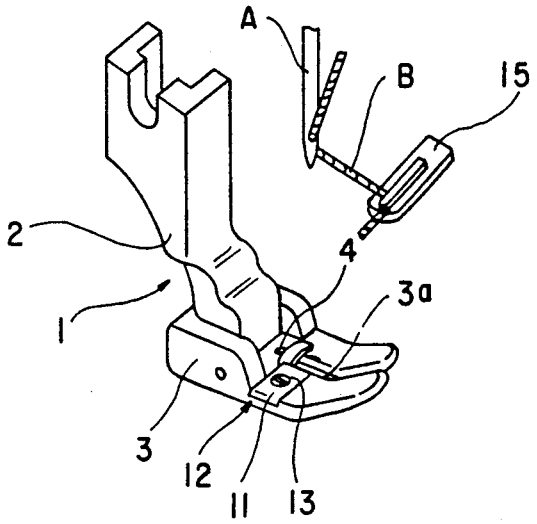
FIG. 1 is a perspective view of a cloth presser provided with a thread end holder according to a preferred embodiment of the present invention.
Figure 2:
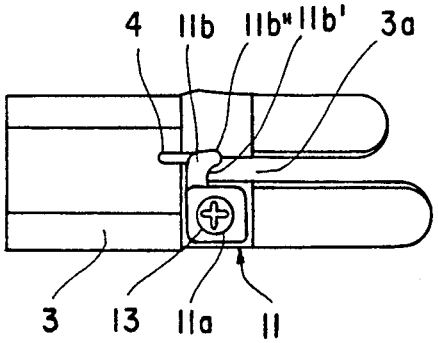
FIG. 2 is a plan view of a cloth presser foot shown in FIG. 1.
Figure 3:
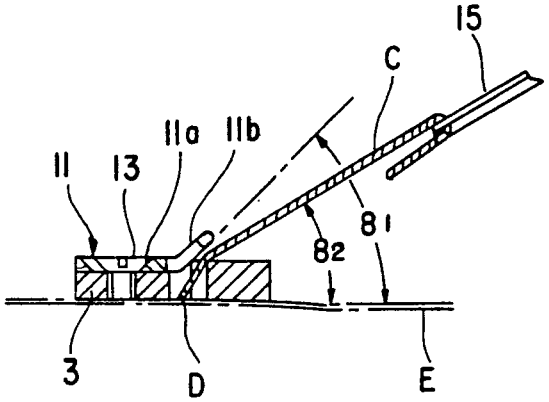
FIG. 3 is a cross sectional detail view showing the relationship of thread, needle thread restriction plate and cloth presser foot in the structure of FIG. 1.

Referring now to FIGS. 1–3, a cloth presser 1 provided with the thread end holder comprises a presser supporter 2. A cloth presser foot 3 is pivotally mounted on the presser supporter 2 and is composed of a base and a pair of projections projecting laterally from the base. A needle location groove 3*a* is defined between the pair of projections. A thread end guide groove 4 is defined in the base and communicates with the needle location groove 3*a*. A needle thread restriction plate 11 is used to prevent a needle thread from sliding into the thread end guide groove 4. A stationary knife 6 is secured to a rear surface of one of the lateral projections of the cloth presser foot 3 and extends at right angles thereof to cross the thread end guide groove 4. A thread end holder 15 is positioned beside the cloth presser 1.

A needle thread B threaded into a hole of a needle A is further threaded into and held by the thread end holder 15 and extends into the needle location groove 3*a* for forming an extension portion of thread C used for forming a first stitching operation.

The needle restriction plate 11 comprises as shown in detail in FIG.2, a flat base plate 11*a* and an inclined portion 11*b*. The inclined portion 11*b* comprises a recess 11*b* having a width substantially the same as the width of the needle location groove 3*a* and a convex portion 11*b* defined at the tip end thereof and communicating with the recess 11*b*. An inclined angle $\theta 1$ defined between the inclined portion 11*b* and a sewn material E is set to be greater than an inclination angle $\theta 2$ defined between the extension thread C and the sewn material E. Thread C is extended between the holder 15 and the first stitch D. The needle restriction plate is open at the side of the thread end holder 15 and is secured to one of the lateral projections of the cloth presser foot 3. The flat base plate 11*a* thereof is embedded into a recess 12 defined in the surface of the cloth presser foot 3 by a set screw 13 so as to cover the thread end guide groove 4.

Figure 4:
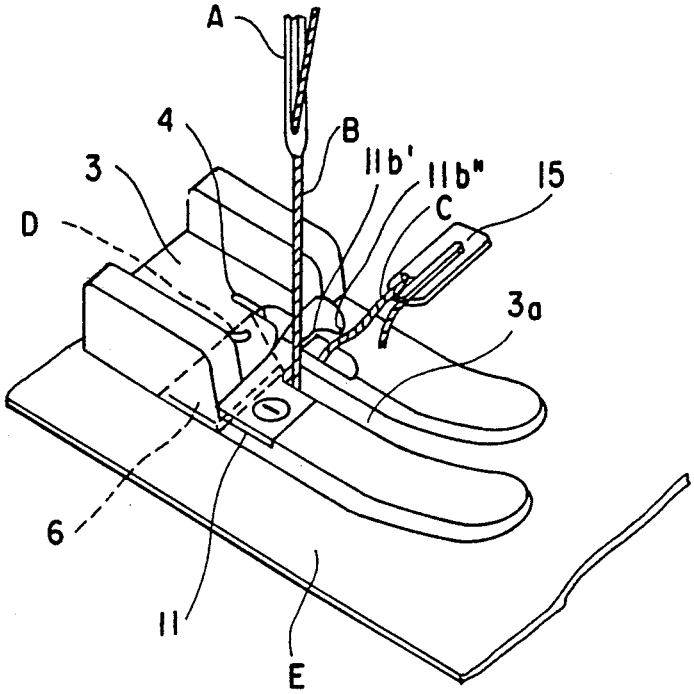
FIG. 4 is a perspective view illustrating the operation of the cloth presser with thread end holder of FIG. 1.
Figure 5:
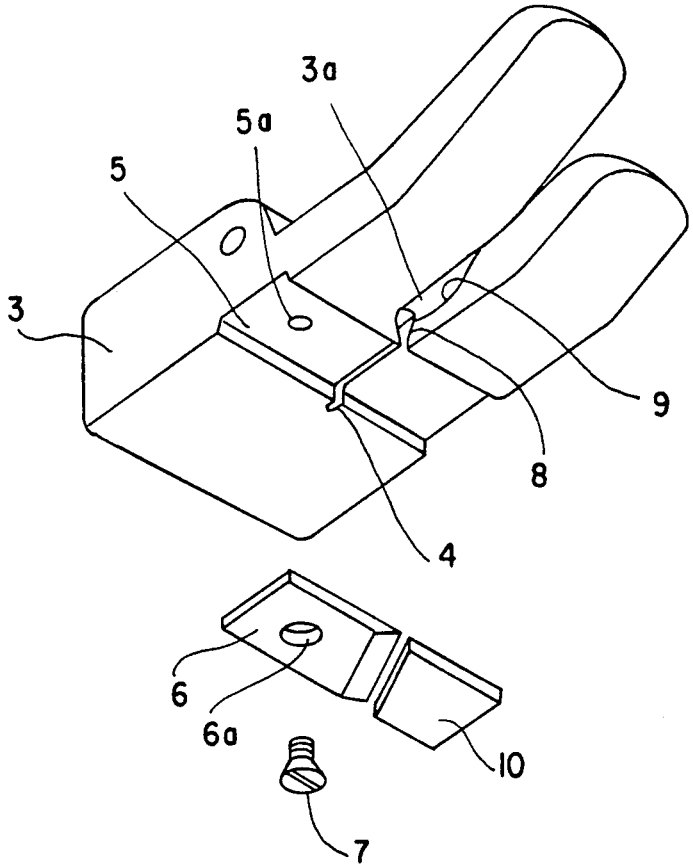
FIG. 5 is an exploded perspective of a prior art cloth presser provided with a thread end holder.
Figure 6:
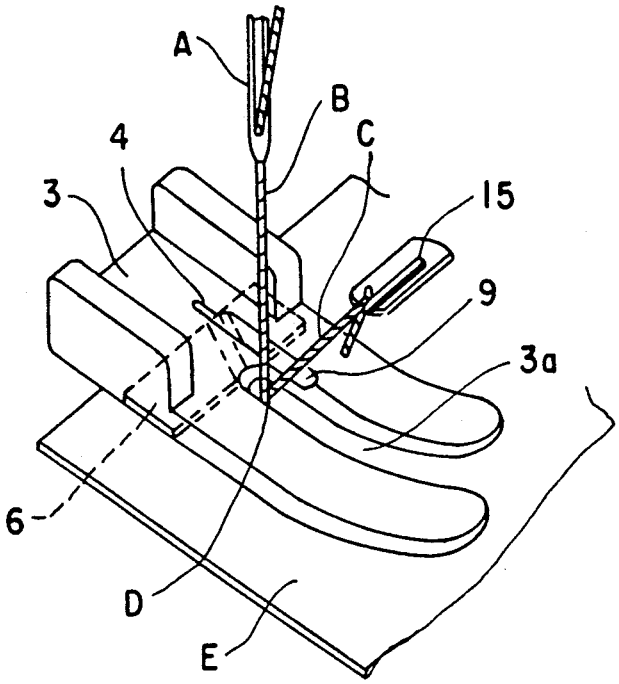
FIGS. 6 and 7 are detail perspective views illustrating operations of the prior art cloth presser of FIG. 5.
Figure 7:
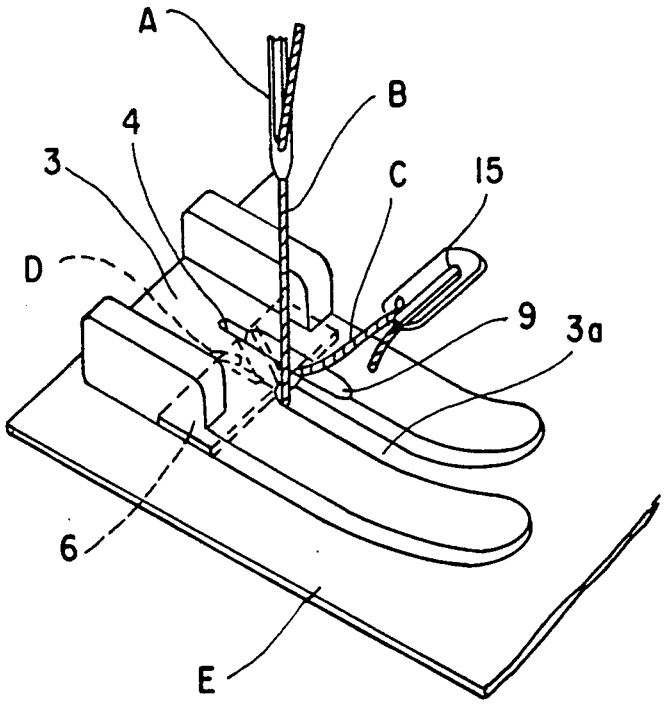

An operation of the cloth presser provided with a thread end holder in accordance with the present invention will be described hereinafter with reference to FIG. 4.

Inasmuch as the inclined angle $\theta 2$ of the extention thread C is less than the inclined angle $\theta 1$ of the needle restriction plate 11, the first stitch D formed in the sewn material E is guided into the thread end guide groove 4 from the needle location groove 3*a* without hindrance by the needle restriction plate 1 is cut by the secured knife 6. The needle thread B is disposed on a vertical moving line of the needle A toward the sewn material E so that the needle thread B cannot be vibrated laterally by the convex portion 11 *b* of the needle restriction plate 11 and will not slide into the thread end guide groove 4 in a manner to be held by the recess 11*b* of the needle restriction plate 1.

The cloth presser provided with a thread end holder according to the present invention can be used with a thread end holder having a pair of knives confronted and crossed with each other in the V-shape under the lower surface of the thread end guide holder and fixed to the cloth presser foot.

As evident from the explanation as set forth above, acccording to the cloth presser provided with a thread end holder, only the extension portion of the thread is cut at the first stage of the stitching operation and the needle thread can be prevented in a reliable manner from being cut incidentally during the stitching operation whereby the working efficiency can be substantially improved.

Although the invention has been described in its preferred form with a certain degree of particularity it is to be understood that many variations and changes are possible in the invention without departing from the scope thereof.

What is claimed is:

1. In combination:

a cloth presser;

a thread end holder positioned beside the cloth presser and adapted to hold an end of an extension thread;

a presser supporter;

said cloth presser foot pivotally mounted on the presser supporter, said foot having a base with a pair of projections projecting laterally from the base;

a needle location groove disposed between the pair of lateral projections and extending in a direction of projection;

a thread end guide groove disposed in the base and communicating with the needle location groove;

a needle thread restriction plate mounted on the cloth presser foot for preventing a needle thread from sliding into the thread end guide groove;

a stationary knife secured to rear surface of one of the lateral projections of the cloth presser foot and having a cutting blade disposed at the right angles to and intersecting the thread end guide groove;

the needle thread restriction plate covering an upper surface of the thread end guide groove at an inclined angle $\theta 1$ defined between an inclined portion of the needle thread restriction plate and a sewn material, said angle $\theta 1$ is larger than an inclination angle $\theta 2$ defined between the extension thread and the sewn material.

2. The combination of claim 1 wherein the needle restriction plate includes a flat base plate and said inclined portion, has a recess having a width of substantially the same width as the needle location groove and a convex portion defined at a tip end thereof and communicating with the recess.

* * * * *